United States Patent [19]

Hafner et al.

[11] Patent Number: 5,016,594

[45] Date of Patent: May 21, 1991

[54] FUEL DISTRIBUTOR FOR FUEL INJECTION SYSTEMS OF INTERNAL COMBUSTION ENGINES

[75] Inventors: Udo Hafner, Ludwigsburg; Heinz-Martin Krause, Korntal-Muenchingen, both of Fed. Rep. of Germany

[73] Assignee: Robert Bosch GmbH, Stuttgart, Fed. Rep. of Germany

[21] Appl. No.: 463,572

[22] Filed: Jan. 11, 1990

[30] Foreign Application Priority Data

Mar. 10, 1989 [DE] Fed. Rep. of Germany ..... 3907764

[51] Int. Cl.[5] ..... F02M 61/14; F02M 69/04; F02M 51/06

[52] U.S. Cl. ..... 123/470; 123/456

[58] Field of Search ..... 123/456, 470, 471, 472; 137/343; 251/148; 239/600, 585

[56] References Cited

U.S. PATENT DOCUMENTS 3,941,109 3/1976 Schmid ..... 123/470
4,844,036 7/1989 Bassler et al. ..... 123/470
4,857,003 8/1989 Hafner et al. ..... 439/130
4,860,770 8/1989 Hafner et al. ..... 123/470

*Primary Examiner*—Tony M. Argenbright
*Attorney, Agent, or Firm*—Edwin E. Greigg; Ronald E. Greigg

[57] ABSTRACT

A fuel distributor for fuel injection systems of internal combustion engines having at least one fuel injection valve and at least one valve carrier which has a receiving bore for the fuel injection valve. The fuel injection valve includes an end flange surrounding the receiving bore on which flange the fuel injection valve is axially supported by means of a collar. The end flange of the valve carrier and the collar of the fuel injection valve are embodied as mutually corresponding parts of a bayonet mount, in order to provide positional fixation of the fuel injection valve independently of a plug hood to be mounted onto a protruding end of the fuel injection valve. The plug hood includes blocking tangs on an end face that form-fittingly engage recesses in the bayonet mount that serve the purpose of locking and unlocking the fuel injection valve.

7 Claims, 2 Drawing Sheets

FUEL DISTRIBUTOR FOR FUEL INJECTION SYSTEMS OF INTERNAL COMBUSTION ENGINES

BACKGROUND OF THE INVENTION

The invention relates to a fuel distributor for fuel injection systems of internal combustion engines of the type defined hereinafter.

In a known fuel distributor of this type (German Patent Document 37 30 571 A1), the electromagnetically actuated fuel injection valves, axially inserted into receiving bores, are fixed to the valve carrier by means of a contact strip, which fits in the form of a hood over the part of the fuel injection valve protruding from the receiving bore and its detent protrusions engage corresponding detent recesses in the valve carrier. By means of this contact strip, which simultaneously provides electrical contact of the fuel injection valves, the fuel injection valves are positionally fixed in both the axial and radial directions.

However, tolerance problems between electrical plug prongs in the fuel injection valve and electrical prong outlets in the contact strip may cause a certain amount of twisting of the fuel injection valves during assembly; as a result, the fuel injection valves may not maintain their assigned alignment in the receiving bore, so that the geometry of the fuel stream produced is undesirably altered.

OBJECT AND SUMMARY OF THE INVENTION

A fuel distributor according to the invention has an advantage over the prior art in that the fuel injection valves assume their predetermined position prior to the attachment of a contact hood and are reliably fixed in both an axial and a rotational direction. Thus, in customer service work, for example, the fuel injection valves can be checked in the installed state, without breaking the hydraulic circuit.

By means of the characteristics disclosed herein, advantageous improvements to the fuel distributor defined are possible.

If, in accordance with a preferred embodiment of the invention an end stop, typically present in a bayonet mount, for the rotational motion of a bayonet catch surrounding the fuel injection valve is designed such that the fuel injection valve is locked in the receiving bore by the bayonet mount and assumes a predetermined rotational position, then the desired fuel stream geometry in the installed state, which depends solely on the rotational position of the fuel injection valve and the receiving bore, is reliably attained in each assembly operation.

In a further embodiment of the invention, a contact hood placed over an end of the fuel injection valve serves as a locking means. Locking protrusions on the hood form-fittingly engage recesses in the bayonet mount to prevent rotation of the bayonet catch in the bayonet mount, so that the fuel injection valve is reliably fixed in both its axial and its rotated position. Thus, the fuel distributor is suitable for heavy-duty conditions as well as other conditions.

The invention will be better understood and further objects and advantages thereof will become more apparent from the ensuing detailed description of an exemplary embodiment taken in conjunction with the drawings.

DESCRIPTION OF THE PREFERRED EMBODIMENT

Figure 1:
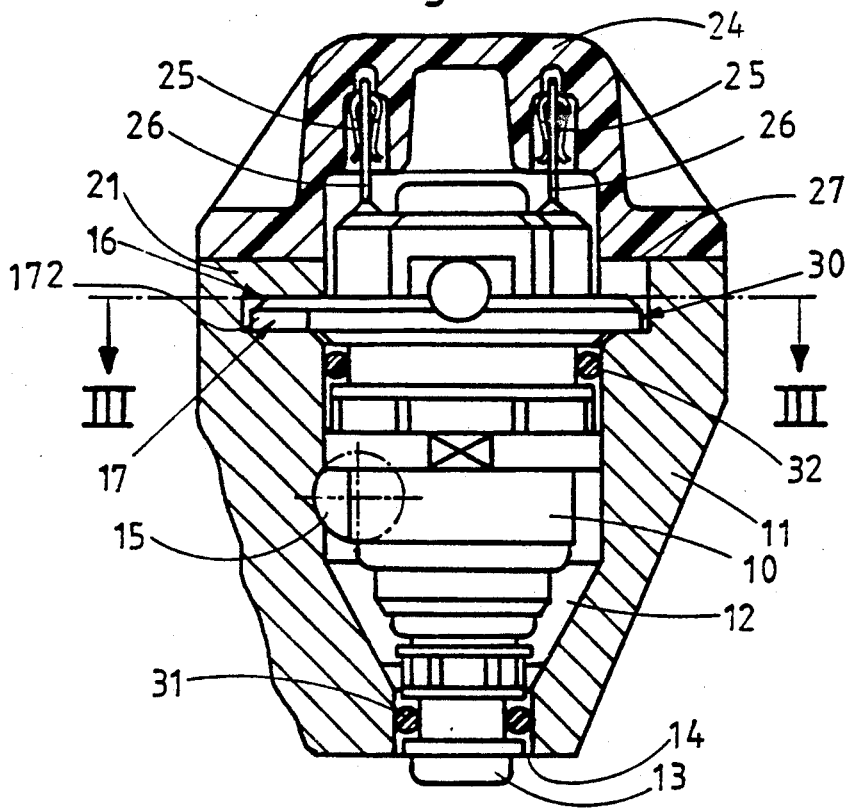
FIG. 1 is a detail of a partial sectional view of a fuel distributor taken along the line I—I of FIG. 3.
Figure 2:
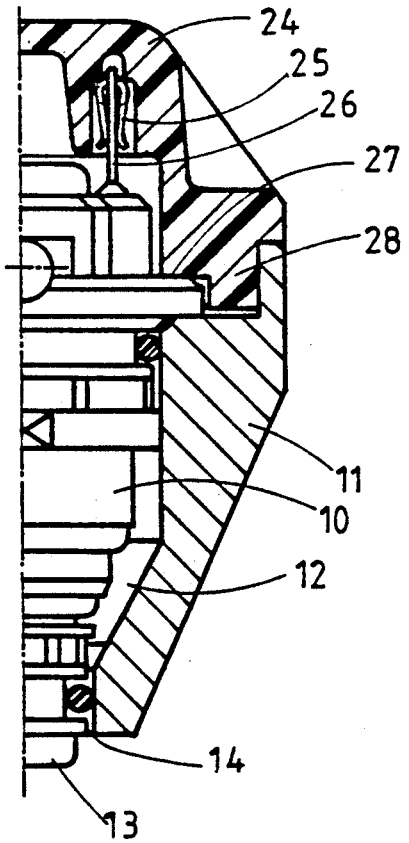
FIG. 2 is a partial sectional view taken along the line II—II of FIG. 3.
Figure 3:
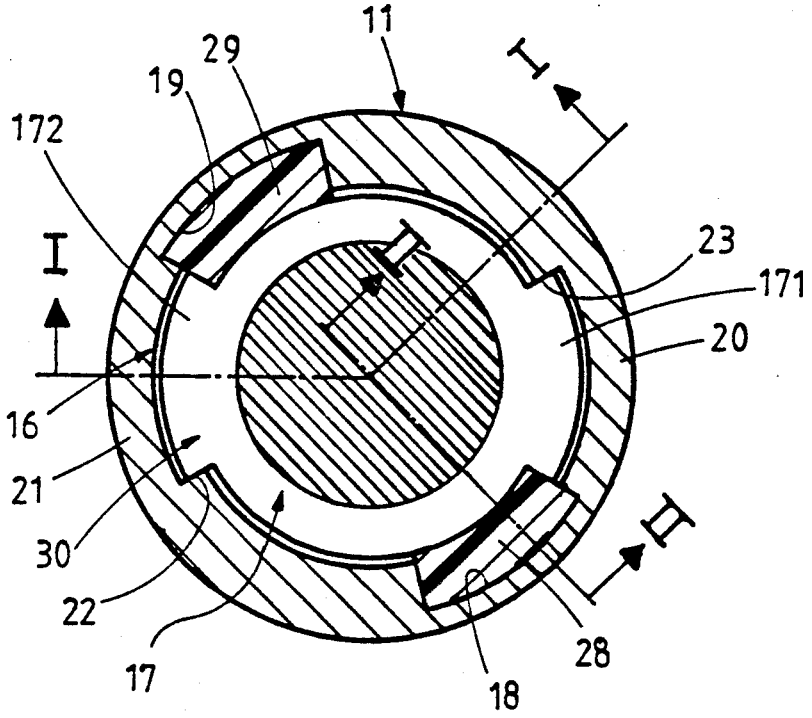
FIG. 3 is a cross sectional view taken along the line III—III of FIG. 1.

The fuel distributor shown in longitudinal section and only in part in FIG. 1 serves the purpose of retention of the fuel injection valve, the fuel supply and electrical contacting of electromagnetically actuatable fuel injection valves 10, only one of which is shown. The valve distributor has a valve carrier 11 with a plurality of stepped receiving bores 12, each of which are open at both ends and into each bore of which one fuel injection valve 10 is inserted. The fuel injection valve 10 includes an injection mouthpiece 13 which protrudes through a discharge opening 14 of the stepped receiving bore 12 and the fuel injection valve communicates with both a fuel supply line 15 shown in dotted lines and a return line, not visible, both of them extending in the valve carrier 11. The fuel supplied via the fuel supply line 15 passes via openings into the interior of the fuel injection valve 10; from there, some of the fuel can be injected via the injection mouthpiece 13, while the rest can flow upward and exit through further openings, in the region of the receiving bore 12 that is in contact with the return line. In a simplified embodiment, the separate return line can be dispensed with. Sealing of the fuel injection valve 10 in the receiving bore 12 is effected via two thick 0-rings 31, 32.

For securing the fuel injection valve 10 to the valve carrier 11, a bayonet lock 16 surrounding the receiving bore 12 is provided on the valve carrier 11; a bayonet catch 17, which comprises two lugs 171, 172, diametrically opposite one another on the valve housing, is provided on the valve housing of the fuel injection valve 10. The catch 17 and the bayonet lock 16 form a bayonet mount 30. In a known manner, the bayonet lock 16 has two recesses 18, 19, for axially introducing the lugs 171, 172 into the bayonet lock 16, and two overlapping portions 20, 21 adjoining them that fit over the lugs 171, 172 after rotation of the bayonet catch 17, which is inserted by its lugs 171, 172 into the recesses 18, 19. A respective stop 22 and 23 for the lugs 171 and 172 is located at the end of the overlapping sections 20, 21. The stops 22, 23 define the rotational position of the fuel injection valve 10 in the receiving bore 12 and thus define the injection geometry of the fuel injection valve 10, and the injection valve assumes a suitable position. With a view to the position of the stops 22, 23, the width of the lugs 171, 172 measured in the circumferential direction is such that when the lugs 171, 172 are in contact with the stops 22, 23, the lugs 171, 172 are completely covered by the overlapping sections 20, 21, and toward the recesses 18, 19 are flush with the overlapping sections 20, 21.

For providing electrical contact for the electromagnetically actuatable fuel injection valve 10, a plug hood 24 formed of a electrical insulating material is used, which covers the part of the fuel injection valve 10 protruding from the receiving bore 12 and closes off the receiving bore 12. One plug hood 24 can be mounted on each fuel injection valve 10. Instead, however—as described in German Patent Document 37 30 571 A1—the plug hoods may be combined into one joint contact strip.

The plug hood 24 includes contact elements 25, which when the plug hood 24 is mounted on the protruding end of the fuel injection valve 10 are seated on contact prongs 26 protruding from the fuel injection valve 10. The contact prongs 26 are electrically conductively connected to the exciter winding of the actuation magnet of the fuel injection valve 10. The contact elements 25 are electrically conductively connected to connection plugs protruding from the plug hood 24. On its end face 27 that can be mounted on the valve carrier 11, the plug hood 24 has two axially protruding blocking tangs 28, 29, which form-fittingly engage the recesses 18, 19 in the bayonet lock 16 when the plug hood 24 is mounted on the fuel injection valve 10. These blocking tangs 28, 29 prevent the bayonet catch 17 from twisting backward and thus fixes the fuel injection valve 10 in the receiving bore 12, in both the axial and the rotational direction.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel distributor for fuel injection systems of internal combustion engines, having at least one electrically actuatable fuel injection valve and at least one valve carrier, said at least one valve carrier has at least one axially open stepped receiving bore, that communicates with a fuel supply line for the fuel injection valve and an end flange surrounding the receiving bore, said fuel injection valve includes a collar which is axially supported on said end flange, said end flange of said valve carrier (11) and said collar of said fuel injection valve (10) are embodied as mutually corresponding parts (16, 17) of a bayonet mount (30).

2. A fuel distributor as defined by claim 1, which includes a bayonet catch part (17) embodied on said collar of the fuel injection valve (10) and a bayonet lock part (16) embodied on the end flange of the valve carrier (11).

3. A fuel distributor as defined by claim 2, which includes a hood covering said at least one receiving bore and a protruding end of said at least one fuel injection valve inserted into said at least one receiving bore, said hood contains contact elements for contacting protruding electrical contact prongs (26) of said electrically actuatable fuel injection valve, said hood (24) includes an end face (27) that can be mounted on said valve carrier (11), said end face includes axially protruding blocking tangs (28, 29), which form-fittingly engage at least two recesses (18, 19) in said bayonet lock (16) that serve a purpose of preventing rotation of or removal of said bayonet catch from the bayonet lock (16).

4. A fuel distributor as defined by claim 2, which includes at least one stop (22, 23) for the bayonet catch (17) in the bayonet lock (16), which at least one stop is disposed such that when said bayonet catch (17) contacts said at least one stop, said fuel injection valve (10) assumes a predetermined position that defines an injection direction.

5. A fuel distributor as defined by claim 3, which includes at least one stop (22, 23) for the bayonet catch (17) in the bayonet lock (16), which at least one stop is disposed such that when said bayonet catch (17) contacts said at least one stop, said fuel injection valve (10) assumes a predetermined position that defines an injection direction.

6. A fuel distributor as defined by claim 3, in which said bayonet mount includes said at least two recesses (18, 19), and said bayonet catch (17) has at least two lugs (171, 172) corresponding with said at least two recesses (18, 19), in which a width of said lugs in a circumferential direction is matched to a position of said stop (22, 23) in the bayonet mount such that when the bayonet catch (17) contacts the stop (22, 23) said lugs (171, 172) expose said recesses (18, 19), and radial limiting edges of said lugs oriented toward the recesses (18, 19) are flush with respective bordering limiting edges of said recesses (18, 19) and said axially protruding blocking tangs (28, 29) on said end face of said hood engage said recesses (18, 19) to prevent rotation of said fuel injection valve.

7. A fuel distributor as defined by claim 5, in which said bayonet mount includes said at least two recesses (18, 19), and said bayonet catch (17) has at least two lugs (171, 172) corresponding with said at least two recesses (18, 19), in which a width of said lugs in a circumferential direction is matched to a position of said stop (22, 23) in the bayonet mount such that when the bayonet catch (17) contacts the stop (22, 23) said lugs (171, 172) expose said recesses (18, 19), and radial limiting edges of said lugs oriented toward the recesses (18, 19) are flush with respective bordering limiting edges of said recesses (18, 19) and said axially protruding blocking tangs (28, 29) on said end face of said hood engage said recesses (18, 19) to prevent rotation of said fuel injection valve.

* * * * *